US007754062B2

(12) United States Patent
Nakanishi et al.

(10) Patent No.: US 7,754,062 B2
(45) Date of Patent: Jul. 13, 2010

(54) METHOD OF PRETREATMENT OF MATERIAL TO BE ELECTROLESSLY PLATED

(75) Inventors: Masatsugu Nakanishi, Shizuoka-ken (JP); Takeshi Bessho, Aichi-ken (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 0 days.

(21) Appl. No.: 10/474,720

(22) PCT Filed: Apr. 8, 2002

(86) PCT No.: PCT/JP02/03513

§ 371 (c)(1),
(2), (4) Date: Oct. 10, 2003

(87) PCT Pub. No.: WO02/088422

PCT Pub. Date: Nov. 7, 2002

(65) Prior Publication Data

US 2004/0115353 A1 Jun. 17, 2004

(30) Foreign Application Priority Data

Apr. 12, 2001 (JP) ..... 2001-114281

(51) Int. Cl.

| | |
|---|---|
| ***C25D 5/56*** | (2006.01) |
| ***C23C 18/20*** | (2006.01) |
| ***C23C 18/28*** | (2006.01) |
| ***C23C 18/30*** | (2006.01) |
| ***B05D 3/10*** | (2006.01) |

(52) U.S. Cl. ..... 205/169; 205/167; 205/210; 205/291; 427/304; 427/306

(58) Field of Classification Search ..... 427/444; 205/169

See application file for complete search history.

(56) References Cited

U.S. PATENT DOCUMENTS 3,867,181 A * 2/1975 Vizurraga ..... 428/375

(Continued)

FOREIGN PATENT DOCUMENTS

EP 156106 1/1985

(Continued)

OTHER PUBLICATIONS

Lewis, Richard, Hawley's Condensed Chemical Dictionary,1993, Van Nostrand Reinhold Company, 12th edition, p. 1060.*

*Primary Examiner*—Katherine A Bareford
(74) *Attorney, Agent, or Firm*—Oblon, Spivak, McClelland, Maier & Neustadt, L.L.P.

(57) ABSTRACT

After treated in a solution containing ozone, a plating material is brought into contact with a solution containing at least one of an anionic surface active agent and a nonionic surface active agent, and an alkaline component. Ozone acts to locally break unsaturated bonds on a surface of the plating material to form C—OH bonds or C=O bonds, thereby activating the surface of the plating material, and since a surface active agent 1 is adsorbed thereon, a catalyst 2 is adsorbed on hydrophilic groups of the surface active agent 1 which has been adsorbed on the above-described functional groups. Consequently, no etching treatment is required, and an electroless plated coating having excellent adhesion can be formed without roughening the surface of the resin material.

16 Claims, 1 Drawing Sheet

U.S. PATENT DOCUMENTS 4,239,538 A * 12/1980 Feldstein ..... 106/1.11
4,307,034 A * 12/1981 Nakayama et al. ..... 558/369
4,505,786 A 3/1985 Birkmaier et al.
4,528,245 A * 7/1985 Jobbins ..... 428/457
4,556,587 A * 12/1985 Tsiamis et al. ..... 427/304
5,803,131 A * 9/1998 Iwasa et al. ..... 138/137
6,319,308 B1 * 11/2001 McComas ..... 106/1.22
6,582,767 B1 * 6/2003 Fukushima et al. ..... 427/304
2006/0108232 A1 * 5/2006 Hiraoka et al. ..... 205/167

FOREIGN PATENT DOCUMENTS

JP 01-92377 4/1989
JP 408092752 A * 4/1996
JP 10-88361 4/1998

* cited by examiner

METHOD OF PRETREATMENT OF MATERIAL TO BE ELECTROLESSLY PLATED

TECHNICAL FIELD

The present invention relates to a pretreatment method for improving the adhesion of a plated coating formed by subjecting a surface of a resin material to an electroless plating.

BACKGROUND ART

The electroless plating has been known as the method for giving electric conductivity and metallic luster to a resin material. This electroless plating is the method of chemically reducing metal ions in a solution, and depositing a metal coating on a surface of a material, and with this method, a metal coating can be formed on an insulator such as resins, too, as is different from electroplating of depositing a metal coating by electrolysis with electric power. In addition, electroplating can be carried out on the resin material on which a metal coating has been formed with electroless plating, thereby enlarging the use of the resin material. For these reasons, the electroless plating has been widely used as the method for giving metallic luster and/or electric conductivity to the resin material for use in various fields such as parts of motor vehicles, household electric appliances, etc.

The plated coating formed with electroless plating, however, has the problems that it takes a considerable time to form the coating, and the adhesion of the coating against the resin material are not sufficient. In order to solve these problems, there have been generally carried out the processes of first chemically etching the resin material to roughen the surface thereof, and then electroless plating the chemically etched resin material.

Furthermore, Japanese unexamined patent publication No. Hei 1-092377 discloses the method of previously treating a resin material with an ozone gas, and then electroless plating the treated resin material. In accordance with this publication, unsaturated bonds in the resin material are unbound to be changed to low molecules, and consequently, molecules having different chemical compositions coexist on a surface of the resin material, whereby the smoothness thereof is lost, and the surface is roughened. Accordingly, the coating formed with electroless plating tightly enter the roughened surface to prevent the coating to readily peel off therefrom.

In the above-described conventional methods, the adhesion of the plated coatings is enhanced with a so-called anchor effect by roughening surfaces of the resin materials. With these methods, however, the surface smoothness of the resin materials decreases. Accordingly, in order to obtain a metallic luster which gives good appearance to the resin materials, the plated coatings must be thick to cause the disadvantage of an increment of manufacturing time.

In addition, in the method of roughening the surface of the resin material by etching, hazardous substances such as chromic acid, sulfuric acid, etc. must be used, and accordingly, there arises problems in the treatment of resultant liquid waste, etc.

The present invention has been made considering these problems of the conventional methods, and has an object of obtaining the method capable of forming a plated coating exhibiting excellent adhesion without roughening a surface of a resin material by etching or ozone gas treatment.

The pretreatment method for an electroless plating material in accordance with the present invention, which is capable of solving the above problems, is characterized by a first treating process of bringing a plating material composed of a resin having unsaturated bonds into contact with a first solution which contains ozone, and a second treating process of bringing a second solution which contains at least one of an anionic surface active agent and a nonionic surface active agent, and an alkaline component into contact with the plating material being carried out.

It is desirable that the first solution contains 50 PPM or more of ozone, and it is desirable that the first solution contains a polar solvent. In addition, it is preferable that the treating temperature in the first treating process is approximately room temperature, and in this case, it is preferable that the treating temperature in the second treating process is higher than that in the first treating process. Furthermore, it is preferable that the concentration of the surface active agent in the second solution ranges from 0.01 to 10 g/L.

BEST MODE FOR CARRYING OUT THE INVENTION

Figure 1:
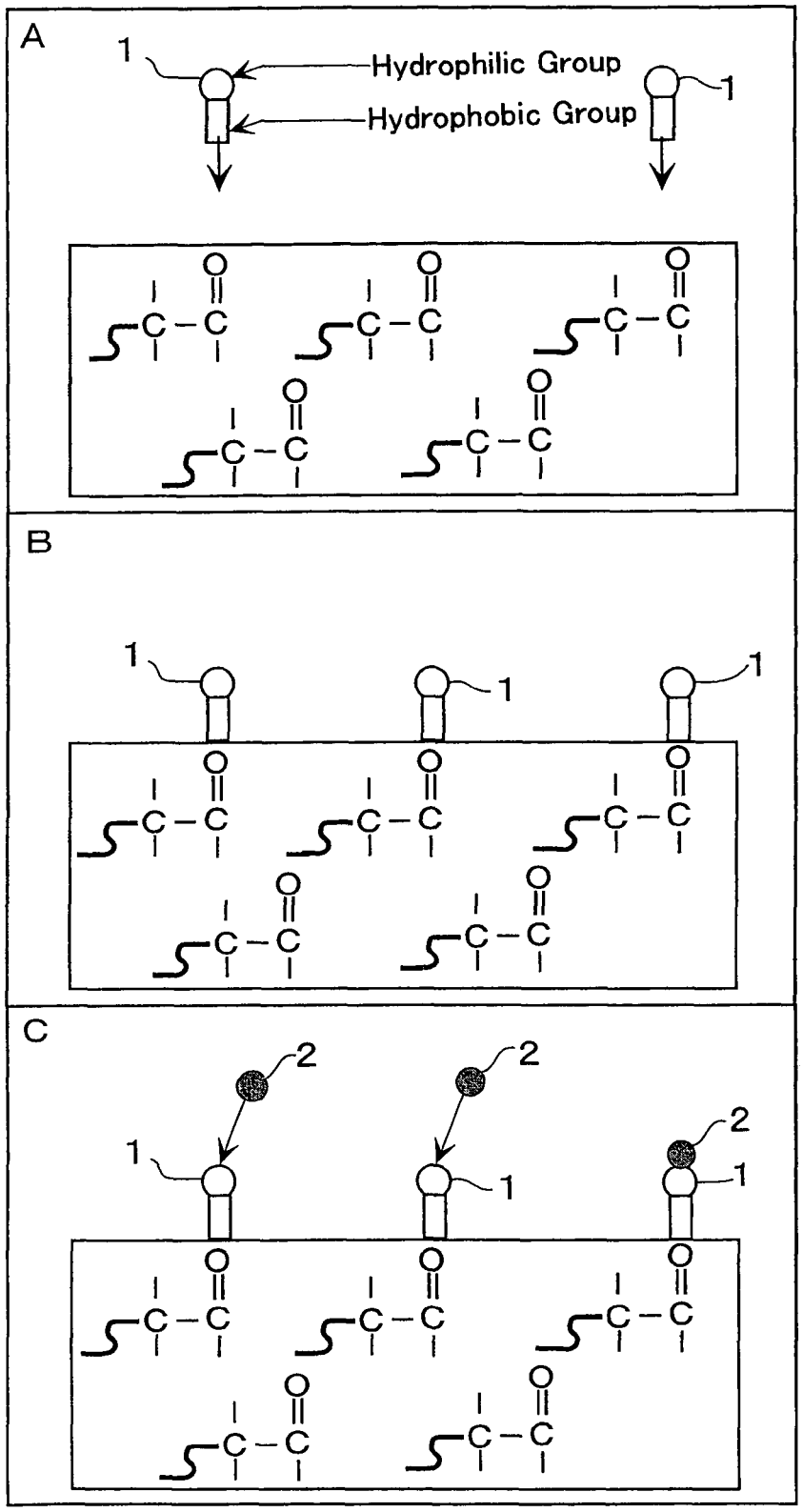
FIG. 1 is an explanation diagram showing presumed operations of the present invention.

In the pretreatment method for an electroless plating material in accordance with the present invention, a resin having unsaturated bonds is used as a plating material. The unsaturated bonds mean C═C bonds, C═N bonds, C═C bonds, etc. ABS resins, AS resins, PS resins, AN resins, etc can be used as the resin having these unsaturated bonds.

And in the pretreatment method in accordance with the present invention, a first treating process of bringing a plating material composed of a resin having unsaturated bonds into contact with a first solution which contains ozone is carried out. It is considered that in this first treating process, the unsaturated bonds on a surface of the plating material are locally broken due to oxidation with ozone contained in the first solution, and consequently, C—OH bonds or C═O bonds are formed to activate the surface of the plating material.

In the first treating process, the plating material is brought into contact with the first solution. In order to bring the plating material into contact with the first solution, the first solution may be sprayed on the surface of the plating material, or the plating material may be immersed in the first solution. The immersing of the plating material in the first solution is preferable, because ozone is difficult to be released from the first solution, as compared with the case the first solution is sprayed on the plating material.

The concentration of ozone in the first solution greatly affects the activation of the surface of the plating material, when the concentration of ozone is about 10 PPM or more, the activating effect is obtained due to the treatment for a long time, and when the concentration of ozone is 50 PPM or more, the activating effect drastically enhanced and the treatment for a short time becomes possible.

Basically, as the treating temperature in the first treating process rises, the reaction rate increases, but as the treating temperature rises, the solubility of ozone in the first solution lowers, and in order to increase the concentration of ozone in the first solution to 50 PPM or more at a temperature higher than 40° C., the treating atmosphere must be pressurized to be more than an air pressure, and consequently, the device becomes large. Accordingly, it is preferable that the treating temperature is adjusted to about room temperature where the device is not desired to become large.

It is desirable that the first solution contains a polar solvent. By virtue of the polar solvent, the activity of ozone in the first solution can be enhanced to enable the treating time in the first treating process to be reduced. Water is especially preferable as the polar solvent, and an alcohol-based solvent, N,N-dimethyl formaldehyde, N,N-dimethylacetamide, dimethyl sulfoxide, N-methyl-pyrrolidon, hexamethylphosphoramide, etc. can be used solely or as a mixture with water and/or an alcohol-based solvent.

In the pretreatment method for an electroless plating material in accordance with the present invention, the plating material treated with the first solution containing ozone is subjected to a second treating process of bringing a second solution which contains at least one of an anionic surface active agent and a nonionic surface active agent, and an alkaline component into contact with the plating material.

It is considered that at least one of functional groups of C═O and C—OH exists on the surface of the plating material due to the first treating process. Accordingly, it is considered that in the second treating process, as shown in FIGS. 1(A), (B), hydrophobic groups of surface active agents 1 are adsorbed on the above-described functional groups appearing on the surface of the plating material. In addition, the alkaline component has the function of dissolving the surface of the plating material on a molecular level, and removing a brittle layer from the surface of the plating material, whereby a larger amount of functional groups are made to exist on the surface of the plating material. And consequently, the surface active agents 1 are also adsorbed on new functional groups appearing due to the removal of the brittle layer.

The surface active agent of which hydrophobic groups are easily adsorbed on at least one of functional groups of C═O and C—OH is used, and at least one of an anionic surface active agent and a nonionic surface active agent is used. In the case of a cationic surface active agent and a neutral surface active agent, it becomes impossible to form a plated coating, or it becomes difficult to achieve the above-described effect. Examples of the anionic surface active agent include sodium lauryl sulfate, potassium lauryl sulfate, sodium stearyl sulfate, potassium stearyl sulfate, etc. And examples of the nonionic surface active agent include polyoxyethylene dodecyl ether, polyethylene glycol dodecyl ether, etc.

The alkaline component capable of dissolving the surface of the plating material on a molecular level to remove the brittle layer can be used, and sodium hydroxide, potassium hydroxide, lithium hydroxide, etc. can be used.

It is desirable to use a polar solvent as a solvent for the second solution containing the surface active agent and the alkaline component, and water can be used as a representative example of the polar solvent. Under certain circumstances, an alcohol-based solvent or a water-alcohol mixture solvent may be used. In addition, in order to bring the second solution into contact with the plating material, the method of immersing the plating material in the second solution, the method of coating the surface of the plating material with the second solution, the method of spraying the second solution on the surface of the plating material, or other methods can be carried out.

It is preferable that the concentration of the surface active agent in the second solution is adjusted to range from 0.01 to 10 g/L. When the concentration of the surface active agent is less than 0.01 g/L, the adhesion of the plated coating lowers, and when the concentration of the surface active agent is greater than 10 g/L, the surface active agent associates each other on the surface of the plating material, and an excess surface active agent remains as impurities, whereby the adhesion of the plated coating lowers; In this case, the plating material may be cleaned with water after the pretreatment to remove the excess surface active agent.

In addition, it is desirable that the concentration of the alkaline component in the second solution is adjusted such that the pH value thereof becomes 12 or more. Even when the pH value is less than 12, the above-described effect can be effected, but the amount of the above-described functional groups appearing on the surface of the plating material is small, whereby it takes a long time to form a plated coating into a predetermined thickness.

The contacting time of the second solution with the plating material is not limited specifically, but 1 minutes or more at room temperature is preferable. If the contacting time is too short, the amount of the surface active agent which is adsorbed on the functional groups may become short to lower the adhesion of the plated coating. However, if the contacting time is too long, even the layer on which at least one of the functional groups of C═O and C—OH appears is dissolved to make the electroless plating difficult. The contacting time of about 1 to 5 minutes is good enough. It is desirable that the treating temperature is as high as possible, and as the temperature rises, the contacting time can be made shorter, but the temperature ranging from room temperature to about 60° C. is good enough. Where the treating temperature in the first treating process is approximately room temperature, it is preferable to make the treating temperature in the second treating process higher than the treating temperature in the first treating process for improving the adsorbing efficiency of the surface active agent.

In the second treating process, after treated with an aqueous solution containing only the alkaline component, the surface active agent may be adsorbed, but there may occur the case where a brittle layer is formed again until the surface active agent is adsorbed, and accordingly, it is desirable that, as set forth in the present invention, the second treating process is carried out in the condition that at least one of the anionic surface active agent and the nonionic surface active agent, and the alkaline component coexist with each other.

In addition, It is preferable to carry out the second treating process after the first treating process, but under certain circumstances, the first treating process and the second treating process can be carried out at the same time. In this case, a mixture solution of the first solution and the second solution is prepared, and a plating material is immersed in the prepared mixture solution, or the prepared mixture solution is sprayed on a surface of the plating material. In this case, the reaction of ozone and the surface of the plating material is a rate-determining step, so that the treating time is determined in accordance with the concentration of ozone in the mixture solution.

The process of removing the alkaline component may be carried out after the second treating process by cleaning the plated coating with water. It has been clarified that since the surface active agent is strongly adsorbed on the functional groups, the surface active agent is not removed by merely cleaning with water, and continuously adsorbed on the functional groups. Accordingly, the plating material which has been pretreated by the method in accordance with the present invention does not lose the effect thereof even after a considerable time has passed prior to the electroless plating process.

Then, in the electroless plating process, the plating material on which the surface active agent is adsorbed is brought into contact with a catalyst liquid. It is considered that this results in, as shown in FIG. 1(C), catalysts 2 being adsorbed on the hydrophilic groups of the surface active agents 1, which have been adsorbed on the above-described functional groups. In accordance with the present invention, since a large amount of surface active agent is adsorbed on the active groups on the surface of the resin material, even if the catalyst liquid of which the concentration is low is used, a sufficient amount of catalyst can be made to adhere to the surface active agent.

And it is considered that by subjecting the plating material to which a sufficient amount of catalyst adheres, to the electroless plating, the surface active agent is released from the functional groups, and metal bonds with the C—O groups and/or C═O groups. Consequently, a plated coating which is excellent in adhesion can be formed.

Catalysts which have been used in conventional electroless plating treatments, such as $Pd^{2+}$, can be used as the catalyst. A solution in which palladium chloride, palladium nitrate, or the like is dissolved, or a solution in which tin chloride or the like is dissolved along with palladium chloride or palladium nitrate can be used as the catalyst liquid. And where an aqueous solution of a mixture of palladium chloride and tin chloride, for example, is used as the catalyst liquid, a sufficient amount of $Pd^{2+}$ can be adsorbed in the case of the concentration of palladium chloride being 0.01 weight % or more, so that a liquid of which the concentration is about half of the conventional concentration will do, and the costs become inexpensive.

In order to adsorb the catalyst on the surface of the plating material, the method of immersing the resin material in a catalyst liquid, the method of coating the surface of the resin material with a catalyst liquid, the method of spraying a catalyst liquid on the surface of the resin material, or like methods can be carried out. And the conditions for these methods are similar to those of the conventional methods, the contacting treatment may be carried out at a temperature from 20 to 30° C. and for 1 to 5 minutes. In this case, after contacting the catalyst liquid, the resin material may be cleaned with water or acid. By cleaning the resin material with acid, the catalyst can be activated.

And, it is considered that by subjecting the resin material adsorbing the catalyst sufficiently to the electroless plating, the surface active agent is released from the active groups on the surfaces of the resin material and a plating metal bonds to the active groups, and consequently, a plated coating which is excellent in adhesion can be formed with a deposition rate of about 100%.

The treating conditions, metals to be deposited, or the like in the electroless plating are not limited specifically. The electroless plating in accordance with the present invention can be carried out, similarly to the conventional electroless plating. And, generally, the electroplating is carried out after electroless plating to give electric conductivity and/or metallic luster to the plating material.

In summary, with the pretreatment method for the electroless plating material in accordance with the present invention, an electroless plated coating having an excellent adhesive strength can be readily formed on a surface of a resin material which has been difficult to be plated with the conventional electroless plating. In addition, since the surface of the resin material is not required to make rough, the plated coating which has a high grade of metallic luster can be formed into a thin thickness, and since chromic acid or the like is not required, the waste disposal becomes facilitated. Upon etching with chlomic acid or the like, the surface of the resin material becomes uneven to such a visible level (order of hundreds nm), but with the pretreatment method in accordance with the present invention, unevenness of the surface becomes invisible level, and accordingly, a thin resin material can be treated with the electroless plating, whereby the resin material can be selected much freely.

Hereinafter, the present invention will be explained concretely in accordance with several embodiments and comparative examples.

EMBODIMENT 1

A first treating process of immersing an ABS resin plate as a plating material in an aqueous solution containing 10 PPM of ozone at room temperature for 30 minutes was carried out.

Next, a mixture aqueous solution in which NaOH was dissolved in the rate of 50 g/L, and sodium lauryl sulfate was dissolved in the rate of 1 g/L was heated to 60° C., and the plating material after the first treating process was immersed in the heated mixture aqueous solution for 2 minutes, whereby an anionic surface active agent (sodium lauryl sulfate) was adsorbed on the plating material (second treating process)

The plating material adsorbing the surface active agent was drawn up and, after cleaned with water and dried, was immersed in a catalyst solution prepared by dissolving 0.1 weight % of palladium chloride and 5 weight % of tin chloride in an aqueous solution of 3N hydrochloric acid, and heating to 50° C., for 3 minutes and then immersed in an aqueous solution of 1N hydrochloric acid for 3 minutes for activation of palladium. With this method, an adsorbing material adsorbing a catalyst was obtained.

Then, the adsorbing material was immersed in a chemical plating bath of Ni—P, which was kept at 40° C., to deposit a Ni—P plated coating for 10 minutes. The thickness of the deposited Ni—P plated coating is 0.5 μm. Then, a copper plating was deposited by a thickness of 100 μm on a surface of the Ni—P plated coating using a copper sulfate-based Cu electroplating bath.

The obtained plated coating was cut to form cuts, each having a width of 1 cm and a depth which reaches the plating material, and the adhesive strength of the plated coating was measured with a tension testor. The measurement result is shown in TABLE 1.

EMBODIMENTS 2 to 7

The pretreatment was carried out by the method similar to that of Embodiment 1 except that the concentration of ozone in the aqueous solution of ozone was changed variously, as shown in TABLE 1, the adsorption of catalyst and the electroless plating were carried out, similarly to Embodiment 1, and the adhesive strength of each of plated coatings was measured. The measurement results are shown in TABLE 1.

EMBODIMENT 8

A plated coating was formed by the method similar to that of Embodiment 1 except that the concentration of ozone in the aqueous solution of ozone is changed to 100 PPM, and that sodium lauryl sulfate was replaced with polyoxyethylene dodecyl ether as a nonionic surface active agent by the amount identical to that of sodium lauryl sulfate. Then, the adhesive strength of the plated coating was measured, similarly to Embodiment 1, and the measurement result is shown in TABLE 1.

COMPARATIVE EXAMPLE 1

The pretreatment was carried out by the method similar to that of Embodiment 1 except that the concentration of ozone in the aqueous solution of ozone was 100 PPM, and sodium lauryl sulfate was replaced with benzyl triethylammonium chloride as a cationic surface active agent by the amount identical to that of sodium lauryl sulfate.

In the present comparative example, no deposition of a Ni—P plated coating was observed, and consequently, no copper plating was formed.

COMPARATIVE EXAMPLE 2

The pretreatment was carried out by the method similar to that of Embodiment 1 except that the treatment with an aqueous solution of ozone was not carried out. Then, a plated coating was tried to form, similarly to Embodiment 1, but no deposition of a plated coating was observed in the conditions identical to those of Embodiment 1.

COMPARATIVE EXAMPLE 3

A plated coating was formed by the method similar to that of Embodiment 1 except that the concentration of ozone in the aqueous solution of ozone was changed to 100 PPM and that an aqueous solution in which only 1 g /L of sodium lauryl sulfate was dissolved without including any alkaline component was used. Then, the adhesive strength of the resulted plated coating was measured, similarly to Embodiment 1, and the measurement result is shown in TABLE 1.

COMPARATIVE EXAMPLE 4

The pretreatment was carried out by the method similar to that of Embodiment 1 except that the concentration of ozone in the aqueous solution of ozone was changed to 100 PPM, and that an aqueous solution in which only 50 g/L of NaOH was dissolved without including any surface active agent was used.

In the present comparative example, no deposition of a Ni—P plated coating was observed, and consequently, no copper plating was formed.

COMPARATIVE EXAMPLE 5

A plated coating was formed by the method similar to that of Embodiment 1 except that a plating material was treated by exposing it to an air which contains 1 volume % of an ozone gas for 10 minutes without using an aqueous solution of ozone before a second treating process. Then, the adhesive strength of the plated coating was measured, similarly to Embodiment 1, and the measurement result is shown in TABLE 1.

COMPARATIVE EXAMPLES 6 to 8

Plated coatings were formed by the method similar to that of Comparative example 5 except that the concentration of an ozone gas was changed variously, as shown in TABLE 1. Then, the adhesive strength of the plated coatings was measured, similarly to Embodiment 1, and the measurement results are shown in TABLE 1.

REFERENCE EXAMPLE

A plated coating was formed by the method similar to that of Embodiment 1 except that the ABS resin plate as a plating material was replaced with a polyurethane resin plate and that the first treating process was not carried out. Then, the adhesive strength of the plated coating was measured, similarly to Embodiment 1, and the measurement result is shown in TABLE 1.

<Evaluation>

Table 1

It is clear from TABLE 1 that the pretreatment method of the present invention enables the formation of an electroless plated coating on ABS with an adhesive strength identical to that on polyurethane. Accordingly, it is considered that with the first treating process of the pretreatment method of the present invention, functional groups composed of C═O or C—OH were formed on ABS, similarly to the case of polyurethane.

And, it is clear that with embodiments, the adhesive strength increases with the increment of the concentration of ozone in the aqueous solution of ozone. In addition, it is clear that when the concentration of ozone exceeds 50 PPM, the adhesive strength remarkably increases, and accordingly the especially preferred concentration of ozone in the first solution is 50 PPM or more.

Furthermore, it is also clear from the results of comparative examples that where the alkaline component is not used, the adhesive strength extremely lowers, and where the surface active agent is not used or the cationic surface active agent is used, the formation of plated coatings is difficult.

And it is clear that even if the treatment with an ozone gas is performed, plated coatings can be formed, but the adhesive strength is low, and that even if the concentration of an ozone gas increases, the effect obtained with the present invention is not obtained. In addition, it was also observed that the surface roughness of the plated coatings formed in the comparative examples 5 to 8 was rough, as compared with the cases of Embodiments. Namely, it is considered that where treated with an ozone gas, plated coatings were formed after merely roughing the surfaces so that functional groups are difficult to be formed on surfaces of ABS resin plates.

TABLE 1

| | | Concentration of Ozone | | Second Solution | | |
|---|---|---|---|---|---|---|
| | Plating Material | Aqueous Solution | Gas | Surface Active Agent | Alkaline Component | Adhesive Strength (g/cm) |
| Ex. No. 1 | ABS | 10 PPM | — | Sodium Lauryl Sulfate | NaOH | 50 |
| Ex. No. 2 | ABS | 20 PPM | — | Sodium Lauryl Sulfate | NaOH | 120 |
| Ex. No. 3 | ABS | 30 PPM | — | Sodium Lauryl Sulfate | NaOH | 120 |
| Ex. No. 4 | ABS | 40 PPM | — | Sodium Lauryl Sulfate | NaOH | 140 |
| Ex. No. 5 | ABS | 50 PPM | — | Sodium Lauryl Sulfate | NaOH | 520 |
| Ex. No. 6 | ABS | 80 PPM | — | Sodium Lauryl Sulfate | NaOH | 600 |
| Ex. No. 7 | ABS | 100 PPM | — | Sodium Lauryl Sulfate | NaOH | 650 |
| Ex. No. 8 | ABS | 100 PPM | — | Polyoxyethylene Dodecyl Ether | NaOH | 520 |

TABLE 1-continued

| | Plating Material | Concentration of Ozone | | Second Solution | | Adhesive Strength (g/cm) |
|---|---|---|---|---|---|---|
| | | Aqueous Solution | Gas | Surface Active Agent | Alkaline Component | |
| Comp. Ex. No. 1 | ABS | 100 PPM | — | Benzyl Triethylammonium Chloride | NaOH | No Desposition |
| Comp. Ex. No. 2 | ABS | — | — | Sodium Lauryl Sulfate | NaOH | No Desposition |
| Comp. Ex. No. 3 | ABS | 100 PPM | — | Sodium Lauryl Sulfate | — | 140 |
| Comp. Ex. No. 4 | ABS | 100 PPM | — | — | NaOH | No Desposition |
| Comp. Ex. No. 5 | ABS | — | 1% | Sodium Lauryl Sulfate | NaOH | 100 |
| Comp. Ex. No. 6 | ABS | — | 3% | Sodium Lauryl Sulfate | NaOH | 200 |
| Comp. Ex. No. 7 | ABS | — | 7% | Sodium Lauryl Sulfate | NaOH | 200 |
| Comp. Ex. No. 8 | ABS | — | 10% | Sodium Lauryl Sulfate | NaOH | 100 |
| Ref. Ex. | Polyurethane | — | — | Sodium Lauryl Sulfate | NaOH | 730 |

The invention claimed is:

1. An electroless plating method, comprising contacting an acrylonitrile butadiene styrene plating material which has unsaturated bonds with a first aqueous solution which comprises 50-100 ppm of ozone, then immersing the plating material in a second aqueous solution having a pH value of more than 12 and which comprises at least one of (i) sodium lauryl sulfate and (ii) polyoxyethylene docecyl ether, and also comprises sodium hydroxide, to adsorb at least one of the sodium lauryl sulfate and the polyoxyethylene docecyl ether on the surface of the plating material, then immersing the plating material having at least one of the sodium lauryl sulfate and the polyoxyethylene docecyl ether adsorbed on a surface thereof in a catalyst liquid comprising a palladium chloride/tin chloride catalyst, to adsorb the catalyst on at least one of the sodium lauryl sulfate and the polyoxyethylene docecyl ether adsorbed on the surface of the plating material, then electroless plating a Ni—P coating onto the plating material having a catalyst adsorbed thereon by immersing the plating material in a Ni—P bath; then electroplating the plating material having a Ni—P coating with a Cu coating by immersing the plating material having a Ni—P coating in a copper sulfate bath to form a plating material having a Cu plating;

wherein the Ni—P plated coating is adhered to the plating material with an adhesive strength of from 520 to 650 g/cm;

wherein the electroless plating method is carried out without roughening the acrylonitrile butadiene styrene plating material by etching or ozone gas treatment prior to plating the plating material.

2. The method as claimed in claim 1, wherein the contacting with the first solution is carried out at approximately room temperature.

3. The method as claimed in claim 1, wherein the immersing in the second solution is carried out at a temperature higher than the temperature of the first contacting.

4. The method as claimed in claim 1, wherein the concentration of said sodium lauryl sulfate in said second solution is from 0.01 to 10 g/L.

5. The method as claimed in claim 1, wherein the contacting with the first solution oxidizes the unsaturated bonds of the acrylonitrile butadiene styrene plating material to form at least one of a C—OH and a C═O group.

6. The method as claimed in claim 1, wherein the contacting with the first solution includes immersing the plating material in the first solution.

7. The method as claimed in claim 1, wherein the contacting with the first solution is carried out at a temperature higher than 40° C. and at a pressure higher than ambient atmospheric pressure.

8. The process as claimed in claim 1, further comprising: removing the alkaline component from the plating material after contacting the plating material with the second solution by cleaning the plating material with water to leave the at least one of the sodium lauryl sulfate and the polyoxyethylene docecyl ether on the plating material.

9. The process as claimed in claim 8, wherein, the removing is carried out before contacting the plating material with the catalyst liquid.

10. The electroless plating method as claimed in claim 1, wherein the catalyst is adsorbed onto at least one of the sodium lauryl sulfate and the polyoxyethylene docecyl ether adsorbed on the surface of the plating material by bonding to at least one of the sodium lauryl sulfate and the polyoxyethylene docecyl ether through a hydrophilic group of at least one of the sodium lauryl sulfate and the polyoxyethylene docecyl ether.

11. The electroless plating method as claimed in claim 1, wherein the plating material is contacted with the catalyst liquid at a temperature of from 20 to 30° C. for one to five minutes.

12. The electroless plating method as claimed in claim 1, further comprising:

cleaning the acrylonitrile butadiene styrene plating material with at least one of water and an acid after contacting the plating material with the catalyst liquid.

13. The electroless plating method as claimed in claim 1, wherein the contacting with the first solution oxidizes the unsaturated bonds of the acrylonitrile butadiene styrene plating material to form C—OH groups.

14. The electroless plating method as claimed in claim 1, wherein the Ni—P plated coating is adhered to the plating material with an adhesion of from 520 to 600 g/cm.

15. The electroless plating method as claimed in claim 1, wherein the second aqueous solution comprises sodium lauryl sulfate and sodium hydroxide.

16. The electroless plating method as claimed in claim 1, wherein the second aqueous solution comprises polyoxyethylene docecyl ether and sodium hydroxide.

* * * * *